US006537182B2

(12) United States Patent
Slawinski et al.

(10) Patent No.: US 6,537,182 B2
(45) Date of Patent: Mar. 25, 2003

(54) SELF-SPOTTING APPARATUS FOR FREE-WEIGHTS

(75) Inventors: Michael D. Slawinski, Suwanee, GA (US); Mikael L. E. Olsson, Buford, GA (US)

(73) Assignee: Prospot, Inc., Suwanee, GA (US)

( * ) Notice: Subject to any disclaimer, the term of this patent is extended or adjusted under 35 U.S.C. 154(b) by 38 days.

(21) Appl. No.: 09/957,152

(22) Filed: Sep. 20, 2001

(65) Prior Publication Data

US 2002/0016239 A1 Feb. 7, 2002

Related U.S. Application Data

(62) Division of application No. 09/385,241, filed on Aug. 28, 1999, now Pat. No. 6,293,892.

(51) Int. Cl.[7] ..... A67B 21/078
(52) U.S. Cl. ..... 482/104; 482/4; 482/93
(58) Field of Search ..... 482/4–8, 93, 98, 482/101, 104, 106, 108, 135; 74/575, 577 R

(56) References Cited

U.S. PATENT DOCUMENTS

| | | | | |
|---|---|---|---|---|
| 4,949,959 A | | 8/1990 | Stevens | 272/123 |
| 4,998,721 A | | 3/1991 | Anders et al. | 272/118 |
| 5,048,826 A | | 9/1991 | Ryan | 272/123 |
| 5,314,394 A | | 3/1994 | Roman | 482/104 |
| 5,310,394 A | | 5/1994 | Kallios | 482/104 |
| 5,468,203 A | * | 11/1995 | Okonkwo | 482/104 |
| 5,716,306 A | | 2/1998 | Gallay | |
| 6,261,205 B1 | * | 7/2001 | Elefson | 482/6 |

OTHER PUBLICATIONS

U.S. application Ser. No. 09/201,434, Slawinski et al., filing date Nov. 30, 1998.
IDS of parent application 09/385,241, copy attached.

* cited by examiner

*Primary Examiner*—John Mulcahy
(74) *Attorney, Agent, or Firm*—Kenneth S. Watkins, Jr.

(57) ABSTRACT

A self-spotting apparatus for free-weights [101] provides two cable assemblies [107A, 107B] with one end of each cable assembly attached to a free-weight assembly [115] and the opposite end attached to respective linear weight-support assemblies [123A, 123B] via respective weight-responsive engagement blocks [125A, 125B]. Guide rods [127A, 127B] allow vertical motion of the engagement blocks and maintain engagement orientation relative to the support assemblies. The engagement blocks engage the respective support assemblies for static support of the free-weight assembly. Lifting of the substantial weight of the free-weight assembly and activation of disengagement bias is required to disengage the engagement blocks from the respective support assemblies to allow free motion of the free-weight assembly. The apparatus provides self-spotting for barbells [115] and dumbbells [247A].

11 Claims, 12 Drawing Sheets

SELF-SPOTTING APPARATUS FOR FREE-WEIGHTS

This is a division of Ser. No. 09/385,241 filed Aug. 28, 1999 now U.S. Pat. No. 6,293,892.

BACKGROUND OF THE INVENTION

1. Field of the Invention

The present invention relates to the field of exercise equipment and, more particularly, to a self-spotting apparatus for free-weights.

2. Description of the Related Art

Despite the variety of exercise and muscle-building equipment and activities available, free-weight lifting continues to be the workout method of choice for many athletes. Free-weight lifting allows unrestrained motion during lifting, closely approximating application of human strength in many recreation and sporting activities. Selection of weights utilized in free-weight lifting is highly repeatable as compared to machines employing levers, cams, and resistance elements such as springs and hydraulic or pneumatic cylinders. Also, free-weights provide uniform resistance unaffected by wear of mechanical parts and other components.

One disadvantage limiting use of free-weights is the need for one or more spotters, especially in strength regimens that push the strength and endurance limits of the user. These regimens are most effective when the user continues repetitions until he or she is unable to lift the weight. This is a safety concern if spotters are not immediately available since the user may be unable to safely lift the weight to a support device. Even when spotters are available, they may not recognize an unsafe condition, or, their response may not be quick enough to prevent injury.

Self-spotting machines, disclosed by others, have addressed eliminating the need for one or more spotters. For example, U.S. Pat. No. 4,949,959 discloses a barbell assist device utilizing a motor-driven yoke assembly. The yoke assembly provides cables that extend around sheaves and downwardly from each end of the housing to support a barbell over a weight bench. U.S. Pat. No. 5,048,826 discloses a device utilizing a winch assembly to retract and release cables supporting the barbell. U.S. Pat. No. 5,310,394 discloses a spotter system for weightlifters employing a pneumatic piston and cylinder. The cylinder provides lift assistance to the barbell through a lever arm, chain drive, pulley and cables.

None of the aforementioned devices provides independent support of both ends of the barbell, nor do they disclose use of the spotting equipment with dumbbells, a popular free-weight. Nor, do any of these references disclose a positive method of ensuring user-control of the weights before disengaging weight support.

U.S. Pat. No. 4,998,721 discloses a weightlifter's exercise apparatus utilizing two motor-assisted assemblies supporting a barbell through cables attached to each end. Although the two motors allow independent assist from each side, no positive method is disclosed to ensuring user-control of the weights before disengaging the supports.

U.S. application Ser. No. 09/201,434, disclosed by the applicant and hereby incorporated by reference, discloses a barbell safety spotting apparatus utilizing two rotary pawl clutches that engage respective chain assemblies connected to barbell support cables. Use of two rotary clutches allows independent motion of the support cables and therefore also the ends of the barbell. The rotary pawl clutches utilize solenoids which engage the clutch and J-shaped indentations which require removal of the weight bias caused by the free-weight before the clutch can disengage. When the clutches are engaged, the free-weights are supported, raised or lowered by a drive unit. When the clutches are disengaged, the cables allow independent and full-range motion of the free-weights.

Application Ser. No. 09/201,434 apparatus makes a significant step forward in providing a weight-responsive element which engages or disengages the free-weight cables to a weight-support assembly. The device also provides self-spotting of dumbbells and allows motion of free-weight ends independent of each other.

Despite the improvements offered in the apparatus of application Ser. No. 09/201,434, use of rotary pawl clutches incorporating solenoids requires rotary electrical power transfer devices such as slip rings. These devices add equipment and maintenance cost to the apparatus. The weight of the chains and counterweights add significant inertia, which must be overcome with each extension and retraction of the free-weights.

OBJECTS AND SUMMARY OF THE INVENTION

Therefore an object of the present invention is to provide a self-spotting apparatus for free-weights which is simple, rugged and low in cost.

A further object of the present invention is to provide a self-spotting apparatus for free-weights which provides weight-support assemblies capable of raising, lowering and statically supporting the full weight of the free-weights.

A further object of the present invention is to provide a self-spotting apparatus for free-weights which provides immediate transfer of weight to the support assemblies upon release of the free-weights by the user.

A further object of the present invention is to provide a self-spotting apparatus for free-weights which utilizes a weight-responsive element requiring the user to support substantially the full weight of the free-weights before disengagement from the support assemblies.

A further object of the present invention is to provide a self-spotting apparatus for free-weights which provides two support assemblies for support of the barbells from both ends an well as separate and independent support for two dumbbells.

A further object of the present invention is to provide a self-spotting apparatus for free-weights in which disengagement of the support cables from the support assemblies allows independent motion of the support cables.

A further object of the present invention is to provide a self-spotting apparatus for free-weights which provides for adjustment of support cable spacing to allow use of different types of free-weights.

A further object of the present invention is to provide a self-spotting apparatus for free-weights which provides powered lifting of the free-weights without use of the user's hands.

A further object of the present invention is to provide a self-spotting apparatus for free-weights comprising low-inertia components which provide engagement with the support assemblies.

A further object of the present invention is to provide a self-spotting apparatus for free-weights which eliminates the need for rotary electrical connectors.

Yet another object of the present invention is to provide a self-spotting apparatus for free-weights which provides cable assemblies on each side, each cable assembly providing backup in case of cable breakage.

Still another object of the present invention is to provide a self-spotting apparatus for free-weights which provides backup of critical weigh transfer components.

A further object of the present invention is to provide a self-spotting apparatus for free-weights which provides "fail-safe" electrical features to provide support of the free-weights upon loss of electrical power to the apparatus or to the electrical components.

The free-weight spotting apparatus of the present invention comprises two weight-support assemblies attached to a support stand. Each of two cable assemblies provides a connection between a free-weight and the respective support assembly through a weight-responsive engagement block constrained to reciprocating linear movement by a linear guide.

The weight-support assemblies provide static support to the free-weight when the weight-responsive engagement blocks are engaged to the respective support assemblies. The user must support the substantial weight of the free-weights in order to unlock and disengage the weight-responsive engagement blocks from the respective weight-support assemblies.

In the preferred embodiments, the weight-support assemblies are continuous chain loops supported vertically in the support stand. The weight-responsive engagement blocks comprise an engagement element such as a pawl which lock-engages the respective chain links in the weight-support direction. Also in the preferred embodiments, the pawls are biased continuously toward engagement by spring pressure and biased away from engagement by solenoids energized by pressure-sensitive switches disposed on the free-weight assembly. Lifting or support of the substantial weight of the free-weight by the user unlocks the pawls from the respective chain links and allows the bias force of the engaged solenoid to overcome the spring direction bias to disengage the pawl of the engagement block from the respective chain loops.

Once the blocks have been disengaged from the chain loops, the blocks reciprocate along the linear guides in response to raising and lowering of the free-weights by the user. When the blocks are both disengaged, free and independent vertical motion of both cables provides true "free-weight" exercise.

Upon de-energizing the solenoids, as would occur by release of a pressure-sensitive switch on the free-weight by the user, the spring bias immediately engages the pawls of the blocks in links of the respective chain loops. Engagement is positive and independent of electrical power.

In the preferred embodiments, the chain loops are supported vertically by lower drive sprockets and upper idler sprockets. A brake motor drives the chain loops through a reducer, providing power raising and lowering of the free-weights when the engagement blocks are engaged to the chain loops. A direction switch located on the support stand energizes the respective forward or reverse windings of the motor through a controller located in the stand. A foot switch provides override to the raise direction of the brake motor. When de-energized, the brake motor provides the static support of the free-weight through the respective drive sprockets, chain loops, block and cable assembly.

Each cable assembly in the preferred embodiment is supported by at least one sheave in the upper portion of the stand between the free-weight and the engagement block. The engagement block acts as a counter-weight maintaining minimum tension on the cable assemblies and aiding disengagement of the pawls when the solenoids are energized. The counterweight force of the engagement blocks biases the blocks in a direction opposite of the lock-engage direction bias of the free-weights.

The preferred embodiments provide two cables arranged in parallel fashion for each cable assembly attaching the free-weights to the respective blocks. Both cables of each cable assembly are sized to carry the full design load of the apparatus. One of the cables of each cable assembly is slightly longer than the other cable in the pair so that in normal operation, only one cable carries the free-weight load. Should cable breakage occur on the tensioned cable, the second cable of the cable assembly will provide full support of the free-weight.

The preferred embodiments also provide pivoting support booms with sheaves at each end for supporting the respective cable assemblies. The outer ends of the support booms adjust to the desired spacing to allow barbell and dumbbell use.

Safety features of the preferred embodiments include dual chain loops including dual drive and idler sprockets for each support assembly, dual engagement pawls, engagement springs and solenoids on each engagement block, and dual, series-connected pressure-sensitive switches on the free-weight assembly such as a barbell. In this manner, neither failure of any one of the dual components, nor power failure to the apparatus will result in the loss of support for the free-weight.

An alternative embodiment utilizes a ratchet bar fixed vertically in the support stand for each of the weight-support assemblies. An engagement block riding on vertical guides comprises a pawl or latch plate which engages teeth of the ratchet bar. Cable assemblies connected each end of a free-weight to the engagement blocks and are supported by cable sheaves on the upper portion of the support stand. In still other embodiments, the linear guide and support assembly are integral components, guiding and engaging the engagement blocks.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a barbell spotting apparatus which provides a user with unconstrained "free weight" use, yet allows power positioning and "dead-man" safe-locking features.

Figure 1:
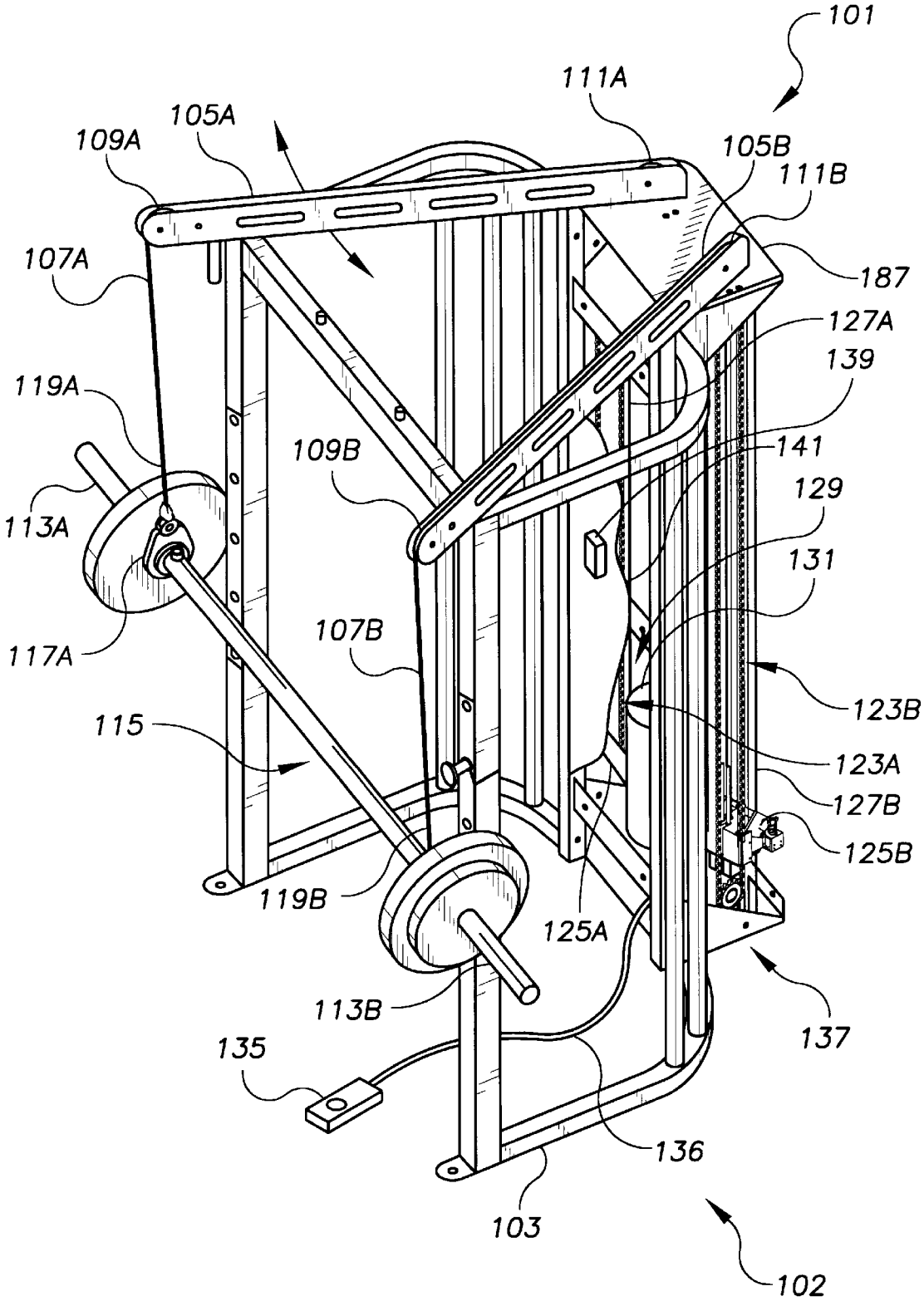
FIG. 1 is a right front-quarter isometric drawing of an embodiment of the self-spotting apparatus for free-weights showing the support stand comprising a frame and two pivoting support booms, right and left cable assemblies supported by sheaves at each end of the support booms attached to a barbell and connected to respective weight-responsive engagement blocks, the blocks engaging respective weight-support chain loops driven by a positioner.

FIG. 1 is right front-quarter isometric drawing of embodiment 101 of the barbell spotting apparatus comprising a support stand 102 having a frame 103, tower enclosure 137 and pivoting weight-support booms 105A and 105B. Cable assemblies 107A and 107B, supported by sheaves 109A and 111A of boom 105A and sheaves 109B and 111B of boom 105B are attached to barbell ends 113A and 113B of a free-weight assembly such as barbell 115. Releasable attachments such as cable attachment assemblies 117A and 117B (shown most clearly in FIG. 7) connect respective cable assembly end portions 119A and 119B to barbell ends 113A and 113B.

Opposite cable assembly end portions 121A and 121B (121B shown best in FIG. 6) are connected to respective weight-support assemblies such as chain assemblies 123A and 123B through chain engagement blocks 125A and 125B. Engagement blocks 125A and 125B reciprocate vertically, constrained laterally by linear guides 127A and 127B and engage the respective chain assemblies to support barbell 115. Engagement blocks 125A and 125B allow independent free-weight movement of barbell 115 when blocks 125A and 125B are disengaged from respective chain assemblies 123A and 123B. Apparatus left side components such as chain assembly 123A, block 125A and guide 127A function the same as right side components such as chain assembly 123B, block 125B, and guide 127B.

Positioner 129 comprises a motor/reducer 131 and drive sprockets (shown best in FIG. 3) which drive and support the lower portions of chain assemblies 123A and 123B. Positioner 129 positions blocks 125A and 125B in the desired vertical position when blocks 125A and 125B are engaged to respective chain assemblies 123A and 123B.

Block 125A and 125B positions determine the position of barbell 115 by linkage through cable assemblies 107A and 107B.

Figure 10:
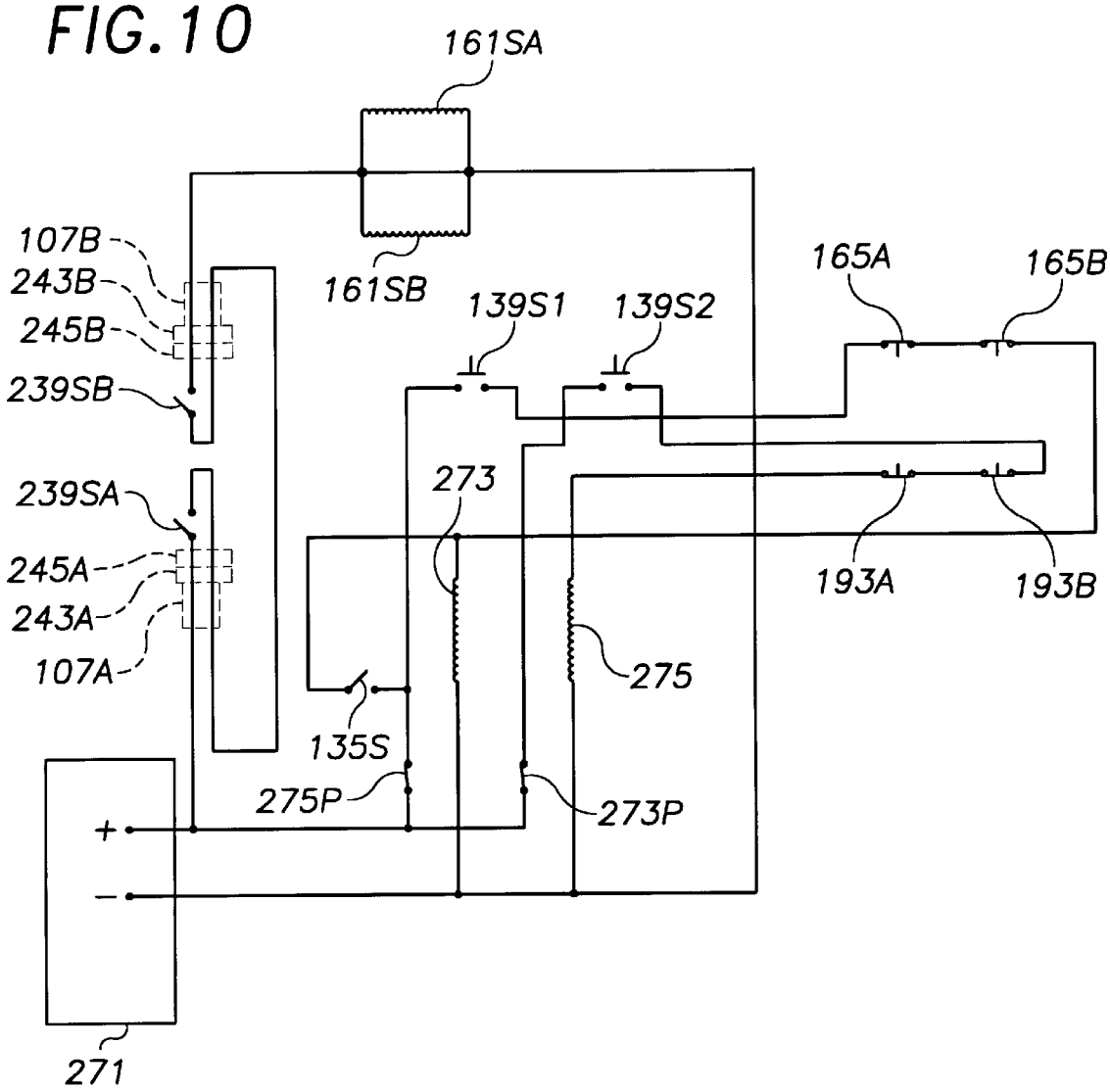
FIG. 10 is an electrical schematic diagram of the electrical controls of the apparatus of FIG. 1 including barbell pressure-sensitive switches, positioner switches, floor switch, engagement block solenoid groups and motor winding relays.

Foot switch 135, connected by cable 136 to the controller circuitry of FIG. 10, energizes positioner 129 to raise barbell 115 when activated. Up/down momentary position switches 139, mounted on tower enclosure front panel 141 (shown in partial cutaway) energizes positioner 129 in a direction to raise and lower barbell 115.

Figure 2:
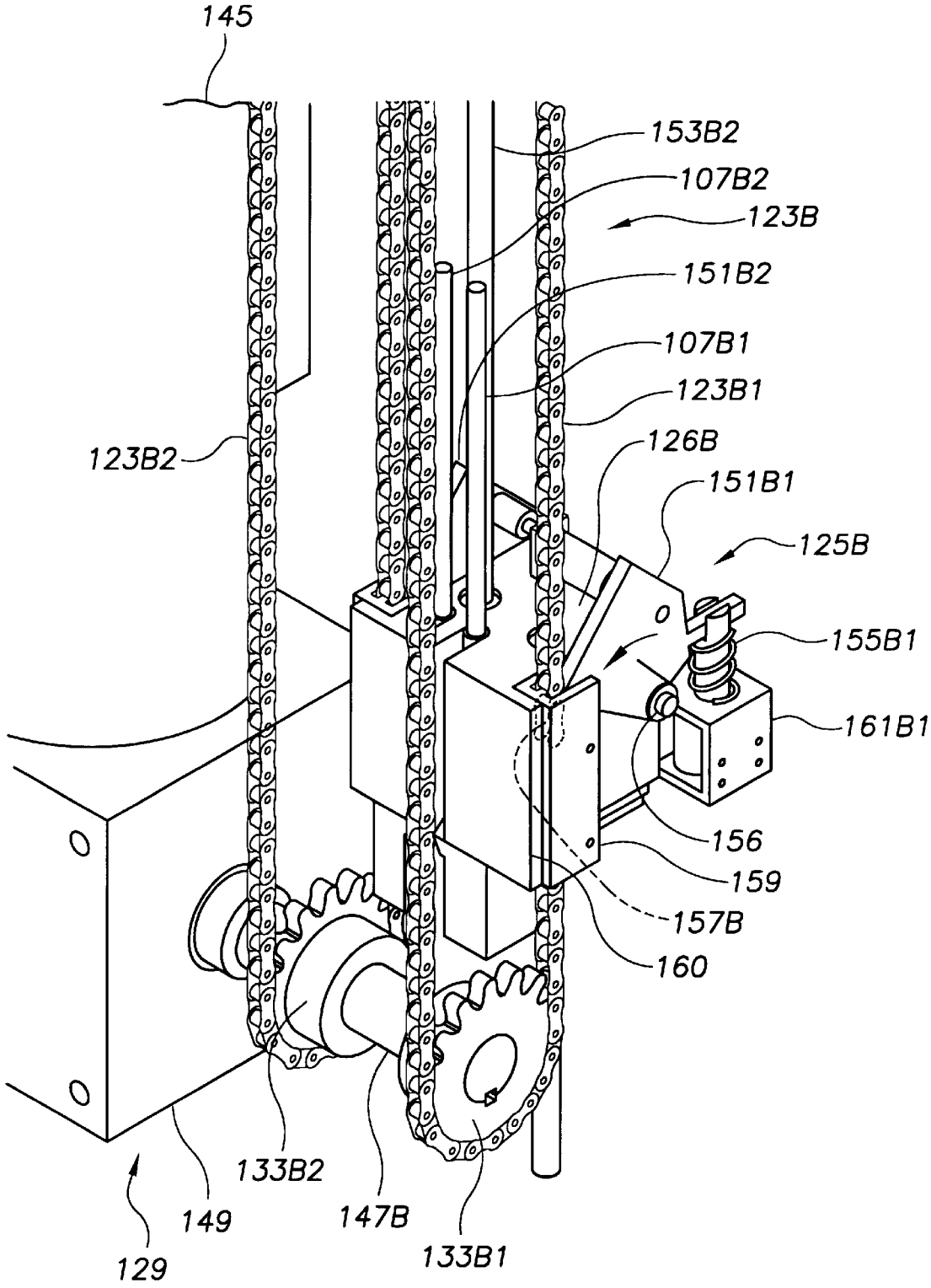
FIG. 2 is a right front-quarter isometric detail drawing of the right engagement block engaging the right weight-support assembly consisting of two continuous chain loops driven and supported by bottom drive sprockets mounted on the gear reducer shaft.

FIG. 2 is a right front-quarter isometric detail drawing showing the lower portion of right side chain assembly 123B, positioner 129, and chain engagement block 125B. The corresponding left side components (chain assembly 123A and right chain engagement block 125A) are similar and perform a similar function. Brake motor 145 rotates right side lower chain sprockets 133B1 and 133B2 of right drive shaft 147B through right angle reducer 149. Sprockets 133B1 and 133B2 are keyed to shaft 147B to lock the sprockets rotationally to shaft 147B.

Right side chain assembly 123B comprises two continuous chain loops, 123B1 and 123B2, supported by upper and lower sprockets. Upper idler sprocket (185B1 of FIG. 5) and lower sprocket 133B1 support chain loop 123B1 in a vertical orientation. Sprocket 133B1 drives loop 123B1 in either direction, depending on the rotational direction of drive sprocket 133B1. In a similar manner, upper idler sprocket (185B2 of FIG. 5) and lower sprocket 133B2 support chain loop 123B2 in a vertical orientation, with drive sprocket 133B2 positioning chain loop 123B2 when rotated by brake motor 145 through reducer 149.

Pawls 151B1 and 151B2 of chain engagement block 125B engage and lock block 125B to chain loops 123B1 and 123B2. In this manner, positioner 129 positions block 125B in the desired vertical position through rotation of lower drive sprockets 133B1 and 133B2. Linear guide rods 153B1 and 153B2 (shown best in FIG. 3), provide a slide fit with linear guide follower apertures 154B1 and 154B2 in body 126B of block 125B and constrain block 125B to linear, vertical motion. The linear guides ensure that pawls 151B1 and 151B2 of engagement block 125B maintain an engageable position with respect to the respective chain loops. Vertical motion of block 125B positions end 113B of barbell 115 of FIG. 1 to the desired position through cable assembly 107B and sheaves 109B and 111B.

Compression spring 155B1, compressed in the position shown, provides engagement force on pawl 151B1 to bias rotation of the pawl in the engagement direction (counterclockwise about pivot pin 156) and engages the tip of pawl 151B1 in link 157B (shown in phantom lines) of chain loop 123B1. The weight of barbell 115 produces an upward force on block 125B though tension in cable assembly 107, and provides a supplemental or locking engagement force by attempting to further rotate pawl 151B1 in the engagement direction. Since support channel 159, supported by backing plate 160 prevents forward (away from pawl 151B1) movement of chain link 157, pawl 151B1 engages link 157 harder with increasing downward force on barbell 115.

Figure 4:
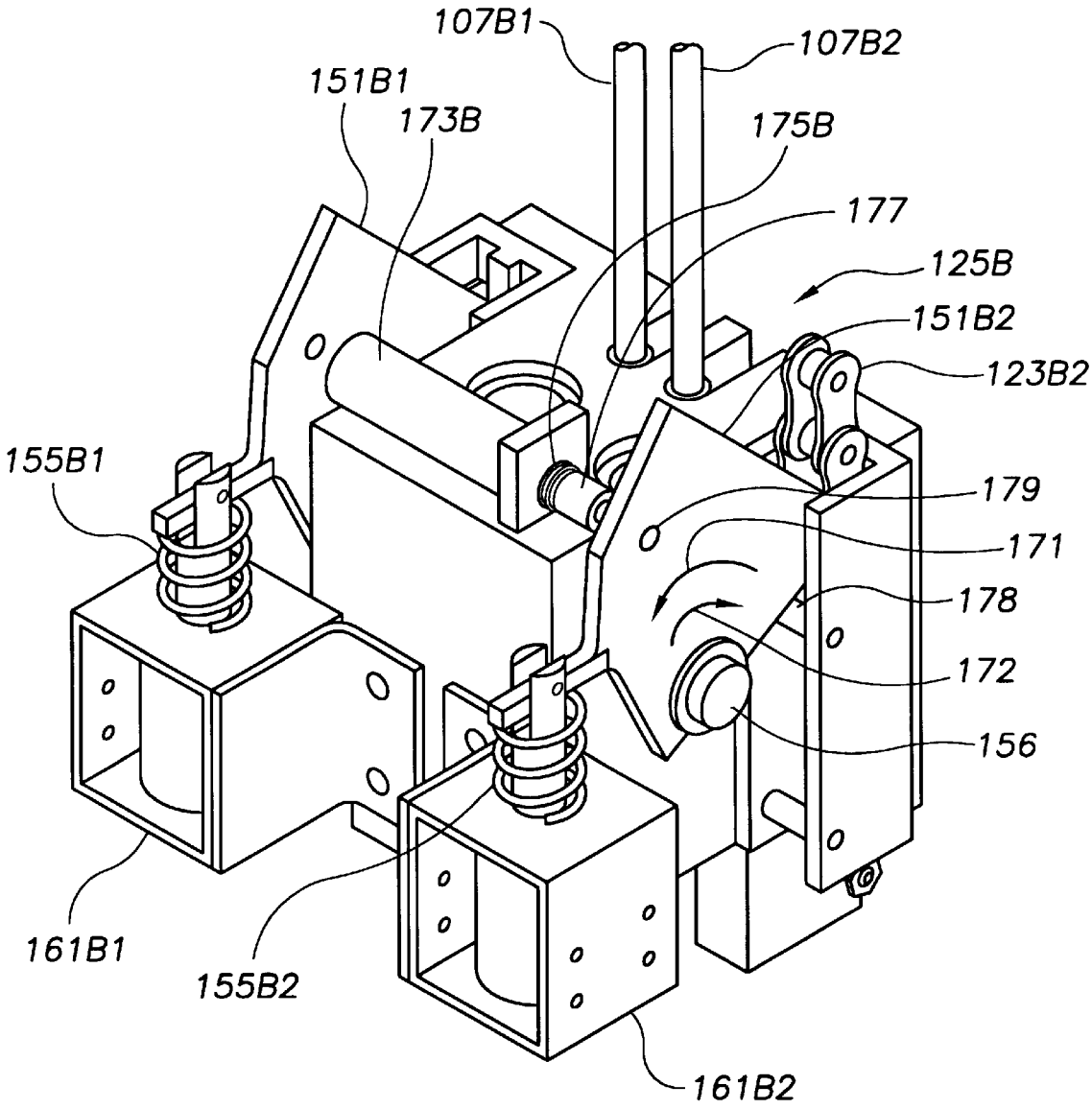
FIG. 4 is a left rear-quarter isometric detail of the right side engagement block showing two engagement pawls, one shown engaging a link of one of the right chain loops.

Counterclockwise or locking direction engagement rotation of pawl 151B1 stops when pawl 151B1 is pushed back fully against support channel 159, or optionally, contacts a mechanical stop (178 of FIG. 4). In the preferred embodiments, support channel 159 is made of a high compression-strength plastic material such as ultra-high density molecular weight polyethylene or polyamide to support the respective chain loops and provide a low friction bearing surface. In the preferred embodiments, block 125B is made of steel and pawls 151B1 and 151B2 are made of high strength tool steel.

Energizing solenoid 161B1 provides a disengagement force and biasing pawl 151B1 in a disengagement (clockwise) direction about pivot pin 156. Although this disengagement force is greater than the engagement force provided by spring 155B, it is less than that needed to overcome the locking engagement force resulting from the weight of barbell 115 acting through cable assembly 107.

In a preferred embodiment, disengagement of pawl 151B from link 157 of chain loop 123B1 requires countering of much or most of the weight of barbell 115 acting on block 125B. In the most preferred embodiments, disengagement of pawl 151B from link 157 of chain loop 123B1 requires countering of all of the weight of barbell 115. Countering of weight from barbell 115 may be accomplished by lifting barbell 115 vertically against gravity, thereby removing tension in cable assembly 107B.

In this manner, block 105B acts as a weight-responsive engagement assembly, allowing disengagement of the free-weight assembly from the chain loops when a user supports all or a substantial portion of the downward force of the free-weight assembly, yet fully engages the chain loops when the full downward force of the free-weight is transferred to it.

Selection of solenoid 161B retraction force, spring 155B force, or pawl 151B1 dimensions and pivot location provide a means to select the counter force required by the user lifting the barbell to disengage block 125B from chain loop 123B1. Selection of these parameters may also require some downward motion of the block (requiring the user to fully support the free weight, less the counterweight force of the block) in order for the counterweight effect of block 125B to descend, allowing pawl 151B1 to fully clear link 157B and retract to the disengaged position.

Figure 3:
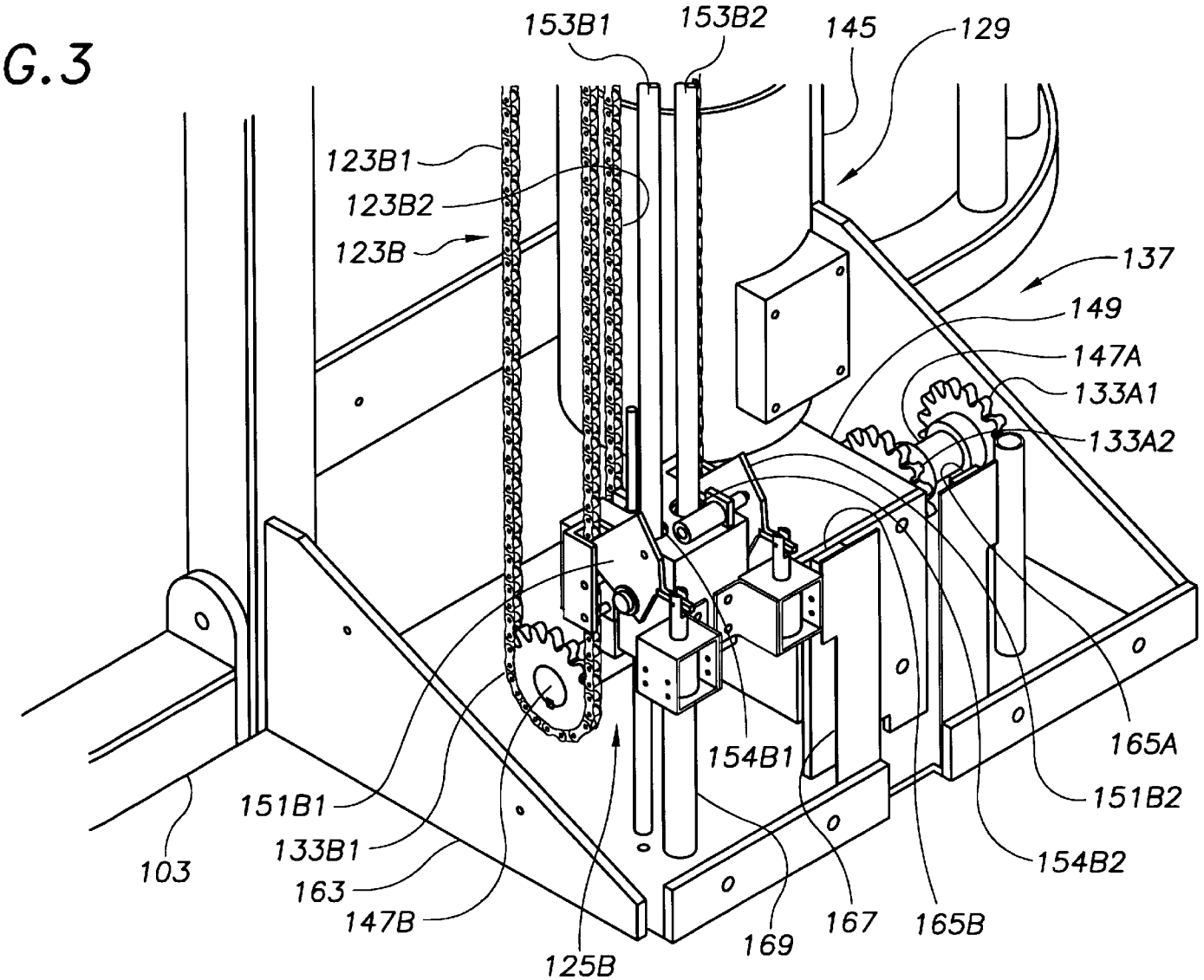
FIG. 3 is a right rear-quarter isometric detail of the lower tower portion of the apparatus showing the lower bracket of the support stand, positioner brake motor and reducer, and the right side engagement block and chain loops.

FIG. 3 is a right rear-quarter isometric drawing of the lower portion of tower enclosure 137 with cover panels removed. Lower bracket 163, fixed to frame 103, supports reducer 149 and brake motor 145. Fasteners (not shown) attach reducer 149 to bottom bracket 163. Shafts 147A and 147B of reducer 149 support and rotate lower drive sprockets 133A1, 133A2, 133B1 and 133B2 as discussed previously. In the preferred embodiment, shafts 147A and 147B are end portions of the same shaft extending through right angle gear reducer 149.

Guide rods 153B1 and 153B2 provide lateral support to block 125B and allow vertical movement of the block. Guide rod bottom fasteners (not shown) attach the bottom of guide rods 153B1 and 153B2 to bottom bracket 163. Chain loops 123B1 and 123B2 provide vertical support and vertical positioning of block 125B when engaged to pawls 151B1 and 151B2 of block 125B. In the preferred embodiments, guide rods 153B1 and 153B2 are steel pipe of circular or rectangular cross-section. In other embodiments, one or more structural shapes such as I-shapes or T-shapes may be used.

Upper limit switch 165B, attached to bracket 167 stops motor 145 when block 125B approaches mechanical stop 169, corresponding to the upper limit of barbell 115. Mechanical stop 169 prevents over-travel of block 125A should limit switch 165B fail. Left side chain assembly 123A, block 125A and guide rods 151A1 and 151A2 are not shown for clarity, but perform a similar function. Likewise, springs 155B1 and 155B2 are omitted from block 125B in this figure for clarity.

FIG. 4 is a right rear-quarter isometric drawing of engagement block 125B showing pawls 151B1 and 151B2 pivoted about pivot pins 156. Solenoids 161B1 and 161B2 provide a "pull" disengagement force when energized to bias the pawls in the disengagement direction of arrow 171. Springs 155B1 and 155B2, provide a constant "push" engagement force to bias the pawls in the engagement direction of arrow 172.

Solenoid 173B de-energizes with solenoids 161B1 and 161B2. Spring 175B of solenoid 173B biases lock pin 177 of solenoid 173B towards pawl 151B2 to engage and lock in hole 179 of pawl 151B2 when pawl 151B2 is engaged with chain loop 123B2. When engaged, lock pin 177 prevents pawl 151B2 from rotating in direction 171 and disengaging from chain loop 123B2. Lock pin engagement of pawl 151B2 provides positive engagement of pawl 151B2 with chain loop 123B2 during adjustment of chain loop 123B2 position regardless of tension on cables 107B1 and 107B2. This feature also prevents block 125B (which acts as a counterweight, maintaining minimum tension in cable assembly 107B) from disengaging and falling if there is no free-weight on the cables, for example if barbell 115 is removed at cable attachments 117A and 117B.

Energizing solenoid 173B (which in the preferred embodiments occurs with energizing solenoids 161B1 and 161B2) overcomes the engagement bias of spring 175B and disengages lock pin 177 from hole 179 in pawl 151B2, allowing disengagement of pawl 151B2.

Figure 5:
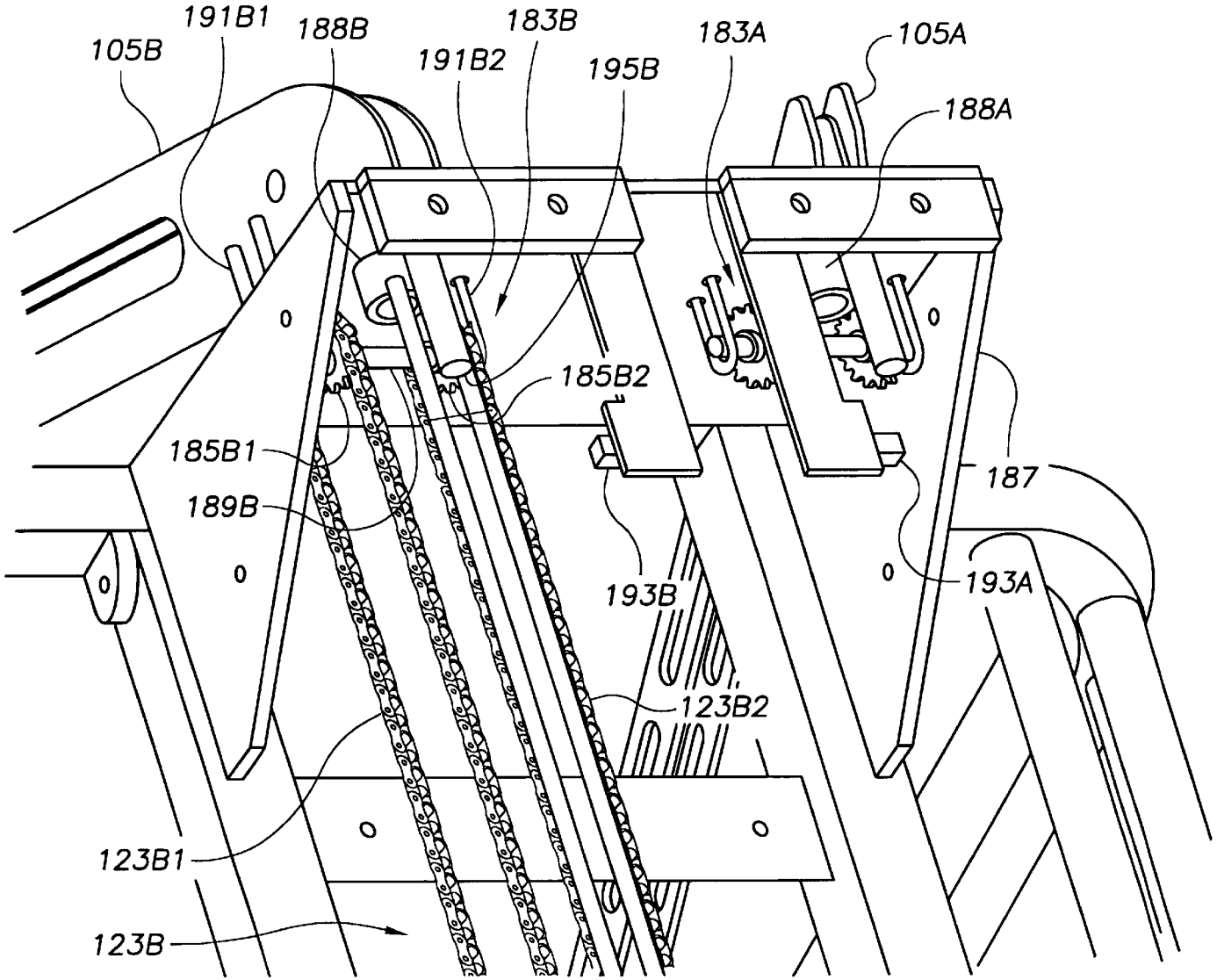
FIG. 5 is a right rear-quarter isometric looking upwards at the idler sprockets and shafts supporting the upper portions of the chain assemblies.

FIG. 5 is a right rear-quarter isometric drawing of top bracket 187 supporting upper idler sprocket assemblies 183A and 183B. Upper sprockets 185B1 and 185B2 engage and support the top of respective chain loops 123B1 and 123B2 of chain assembly 123B. Upper sprockets 185B1 and 185B2 are supported from top bracket 187 via idler shaft 189B and idler shaft U-bolt supports 191B1 and 191B2. Supports 191B1 and 191B2 are supported from top bracket 187 by adjustment bolts and springs (not shown) to provide chain tension adjustment.

Limit switch 193B provides switching to motor controller circuitry shown in FIG. 10 when bock 125B approaches the top portion of tower enclosure 137. Mechanical stop 195B provides a positive stop to prevent block 125B from damaging and disengaging from upper chain assembly 123B and sprocket assembly 183B. Chain upper sprocket assembly 183A function and operation is similar to assembly 183B. Chain loop 123A and the respective cable assemblies are omitted for clarity of the drawing.

Fasteners (not shown) fix guide rods 153A1, 153A2, 153B1 and 153B2 to top bracket 187. Pivot bushings 188A and 188B pivotally attach respective support booms 105A and 105B to top bracket 187.

Figure 6:
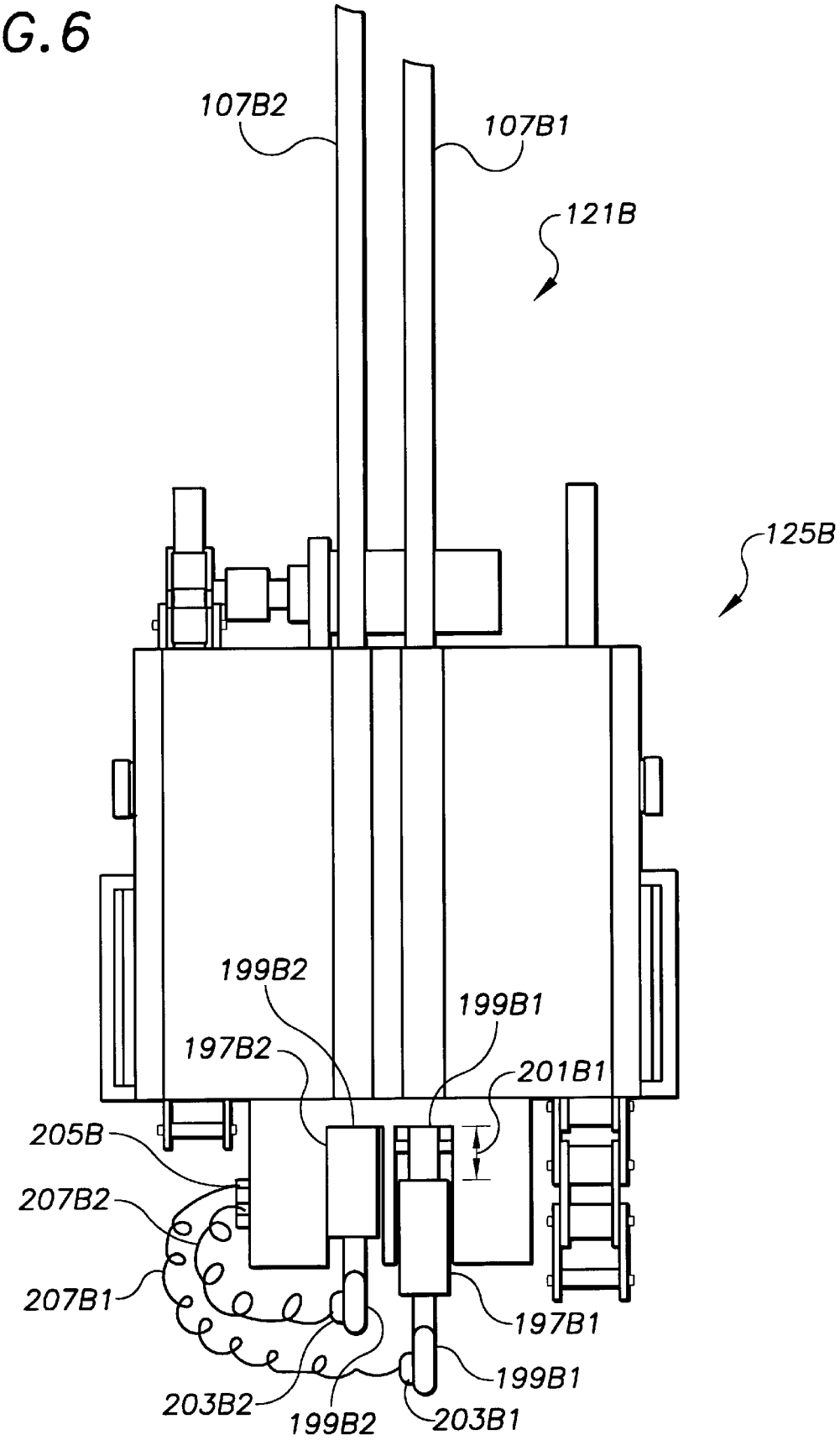
FIG. 6 is a rear elevation drawing of the right side engagement block showing attachment of the two cables of the right cable assembly.

FIG. 6 is a front elevation drawing of bock 125B showing the attachment method of cables 107B1 and 107B2 of cable assembly end portion 121B. Crimp blocks 197B1 and 197B2 crimp the ends of the respective cable loops 199B1 and 199B2 to the respective cables. Cable 107B1 is made slightly longer than cable 107B2 so that tension on cable assembly 107B from the weight of barbell 115 seats crimp block 197B2 against seat 199B2 of block 125B. Due to the longer length of cable 107B1, crimp block 197B1 does not contact seat 199B1, but remains in loose tension due to spacing 201B1. Should cable 107B2 fail under tension, the resulting tension in cable 107B1 of cable assembly 107B will move crimp block 197B1 against seat 199B1, and provide restraining force on further movement of cable 107B1.

Since both cables 107B1 and 107B2 are sized to provide the full design break strength required of the apparatus, the dual cable design provides a measure of safety since only one cable is under tension in normal operation. Should the cable under tension fail, a previously non-tensioned cable will provide full backup. However, breakage of a cable will interrupt control current flow in one of the cable assemblies of FIG. 10, locking the blocks to the chain loops and preventing normal use of the equipment. In the preferred embodiments, cables 107B1 and 107B2 are aircraft grade steel cables to provide high strength.

Cables 107B1 and 107B2 provide electrical connections for bock 123A and 123B solenoid actuation as shown in the schematic diagram of FIG. 10. Flexible wires 207B1 and 207B2 connect loops 199B1 and 199B2 of cables 107B1 and 107B2 to terminal block 205. The electrical connections 203B1 and 203B2, which may be solder connections or crimp connections, provide a secure electrical connection between cable loops 199B1 and 199B2 and wires 207B1 and 207B2. Seats 199B1 and 199B2 are electrically insulated from each other, for example, by one or both seats made of an electrically insulative material. Construction and operation of block 121A and cable assembly end portion 121A is similar.

Figure 7:
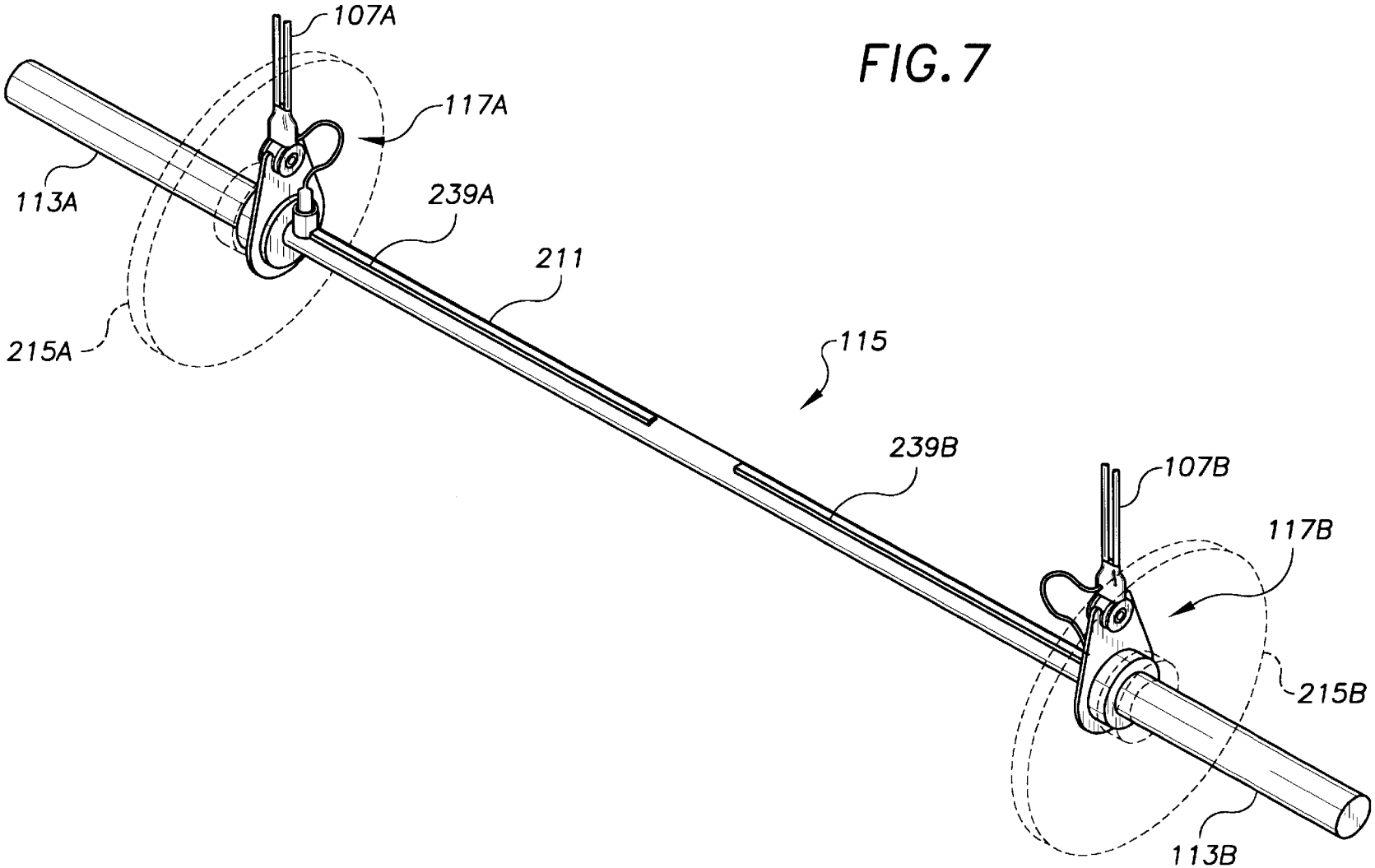
FIG. 7 is a right front-quarter isometric drawing of the barbell showing right and left pressure-sensitive switches, cable attachment assemblies, and right and left cable assemblies.

FIG. 7 is a right front-quarter isometric of barbell 115 of the present invention comprising cable attachment assemblies 117A and 117B connecting respective cable assemblies 107A and 107B to bar portion 211. Barbell ends 113A and 113B provide bar ends dimensioned for attachment of standard free-weights 215A and 215B, shown in phantom lines.

Figure 8:
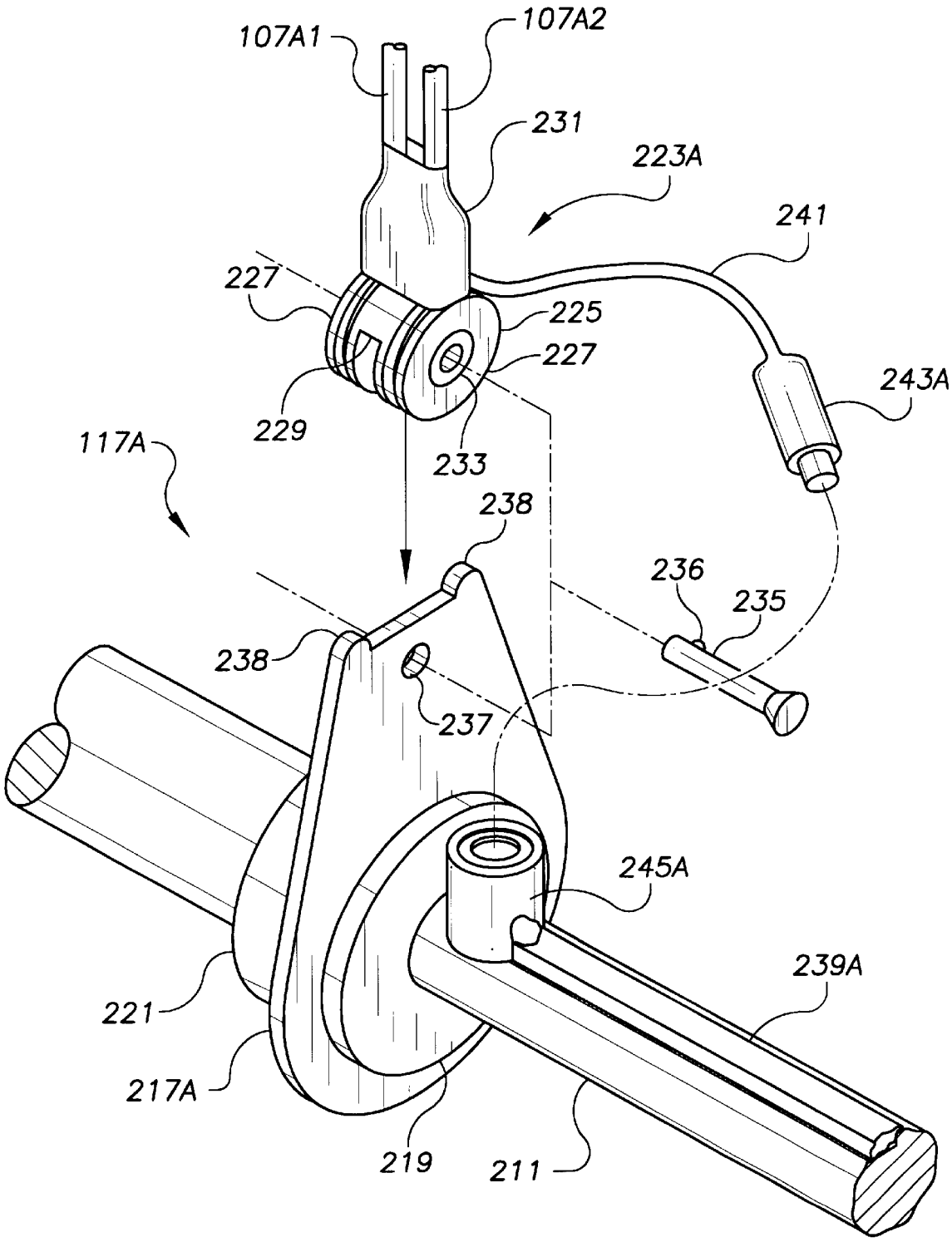
FIG. 8 is a isometric detail of the left cable attachment assembly of the barbell, showing mechanical and electrical connections to the barbell.

FIG. 8 is an isometric detail of cable attachment assembly 117A showing bar attachment flange 217A fixed to bar 211 by bushings 219 and 221. Cable attachment fitting 223A comprises slotted bushing 225 having two cable loop disc portions 227 and alignment slot 229. Cables 107A1 and 107A2 are looped around slots in the respective disc portions of bushing 225 and crimped to the cable by cable crimps (not shown). In the preferred embodiments, slotted bushing 225 is made of an electrically insulative material such as high strength plastic. Loop bushings 233, made of metal and located in each disc portion 227, provide strength for transmitting force from the respective cables to pin 235 when inserted through bushing 225 and hole 237 of bar attachment flange 217A. Slot 229 and bushing alignment guides 238 allow quick alignment of loop bushings 233 and hole 237 to aid in insertion of pin 235. Spring detent 236 of pin 235 retains pin 235 in bushing 225 until pulled out by a user.

An actuator such as touch sensor or pressure-sensitive switch 239A, mounted on bar 211 by adhesives or mechanical fasteners, provides quick-reaction ability to lock barbell 115 to the respective chain assemblies of FIG. 1. Cables 107A1 and 107A2 provide the electrical connections to the engagement block solenoids through two-conductor cable connector 241, plug 243A and receptacle 245A mounted on bar 211. The conductors of cable connector 241 may be soldered or crimped to the respective cable loops (not shown). The operation and function of cable attachment assembly 107B and pressure-sensitive switch 239B of FIG. 7 is similar.

In embodiments utilizing pressure-sensitive switches as an actuator for the solenoids, the user must exert pressure on the switch, preferably mounted on the upper portion of bar 211, in order to actuate the switch. In other embodiments, a touch sensor is substituted for the pressure switches. Direct contact of the user's hand activates the touch sensor. In still other embodiments, a proximity sensor may be used.

Figure 9:
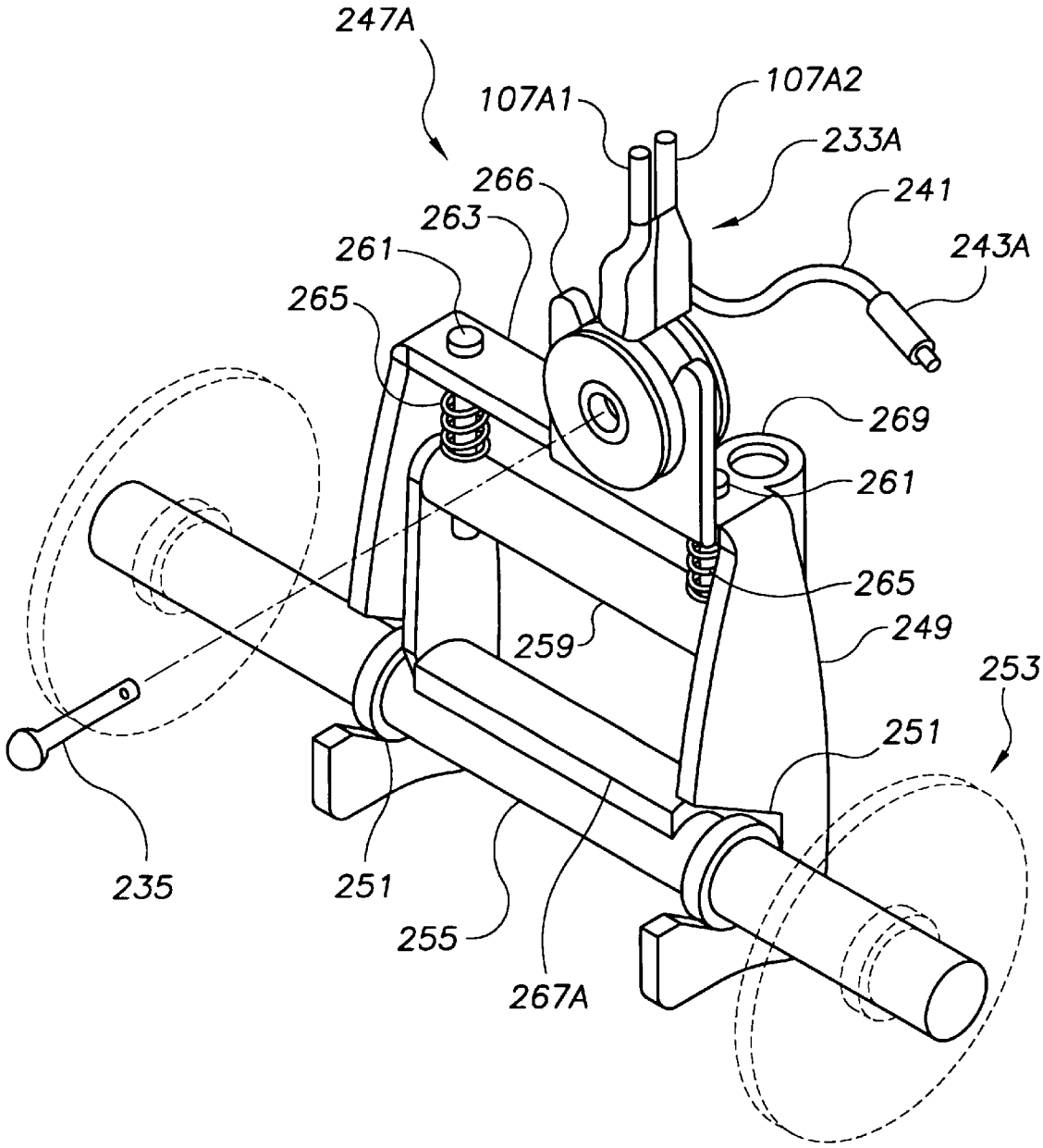
FIG. 9 is a right front-quarter isometric drawing of the left side dumbbell frame supporting a free-weight dumbbell showing the mechanical and electrical connections to the left side cable assembly.

FIG. 9 is an isometric drawing of dumbbell assembly 247A for use singly or in pairs instead of barbell 115. Dumbbell frame 249 comprises barbell slots 251 for insertion and retention of a standard free-weight dumbbell 253. In the preferred embodiments, slots 251 slope downward or are J-shaped to retain bar 255 of dumbbell 253. In this way, bar 253 must be lifted against gravity in order to remove the bar from frame 249. Sub-frame 259, supported from frame 249 by sliding pins 261 in holes of top frame bar 263, is biased against bar 255 by springs 265. Attachment flange 266, fixed to frame 249 by welding or fasteners, provides mechanical attachment of cable attachment fitting 233A to dumbbell assembly 247A similar to that of the barbell of FIG. 8.

Sub-frame 259 comprises a pressure-sensitive switch 267A, similar to that used on barbell 155, and connected to cables107A1 and 107A2 through receptacle 269, plug 243A, and connector 241, similar to barbell 115 connections explained previously. A second dumbbell (not shown) may be connected to cable attachment fitting 233B in a similar manner.

FIG. 10 is a schematic diagram of one embodiment of the electrical controls for the barbell spotting apparatus. A nominal 24 volt D.C. power supply 271 supplies power to the respective positive and negative terminals. Plugs 243A and 243B of respective cable assemblies 107A and 107B connect to receptacles 245A and 245B of barbell 115. Solenoid coil 161SA of block 125A and solenoid coil 161SB of block 125B are energized when contact 239SA of pressure-sensitive switch 239A and contact 239SB of pressure-sensitive switch 239B of barbell 115 are both closed.

Solenoid coil 161SB of this figure represents all three coils of solenoids 161B1, 161B2, and 173B of block 125B connected in parallel. In a similar manner, solenoid coil 161SA of this figure represents all three coils of solenoids 161A1, 161A2, and 173A of block 125A connected in parallel. Gripping and squeezing of the upper portion of barbell 115 of FIG. 7 by the right and left hands of a user will close respective pressure-sensitive switch contacts and energize the solenoids. Opening of either pressure sensitive switch (as would occur upon release of the upper side of the barbell by either hand of the operator) will de-energize the solenoids, engaging the engagement blocks to the chain assemblies.

Figure 10A:
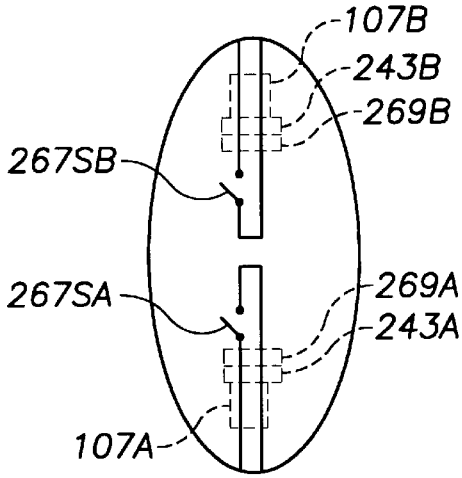
FIG. 10A is an electrical schematic diagram of the dumbbell electrical connections of the electrical controls of FIG. 10.

FIG. 10A shows pressure-sensitive contact connections when dumbbells are utilized with the apparatus. Plugs 243A and 243B of respective cable assemblies 107A and 107B connect to receptacles 269A and 269B of the dumbbells as illustrated in FIG. 9. In this case, release of either pressure-sensitive switch of the dumbbells de-energizes solenoids to both blocks 125A and 125B. In other embodiments, opening of either dumbbell switch de-energizes the solenoids of only the block supporting that dumbbell. This function could be made selective, for example, by a mode selection switch which places only the respective pressure-sensitive switch in series with the respective block solenoids when the "dumbbell" mode is selected.

"Up" relay 273 and "down" relay 275 provide power to the respective forward and reverse direction windings of brake motor 145 when energized. Normally-closed contact 275P of relay 275 and 273P of relay 273 provide protection from energizing both motor windings simultaneously. Activation of "up" contact 139S1 of positioner switch 139 (FIG. 1) energizes "up" relay 273 as long as neither upper limit switch 165A or 165B of FIG. 3 is opened by activation of the respective block approaching the mechanical limit. Likewise, activation of "down" contact 139S2 of positioner switch 139 energizes "down" relay 275 as long as neither lower limit switch 193A or 193B of FIG. 5 are opened.

In the preferred embodiments, closing foot switch contact 135S of foot switch 135 (FIG. 1) energizes "up" motor winding relay 273, regardless of position of the respective blocks.

Figure 11A:
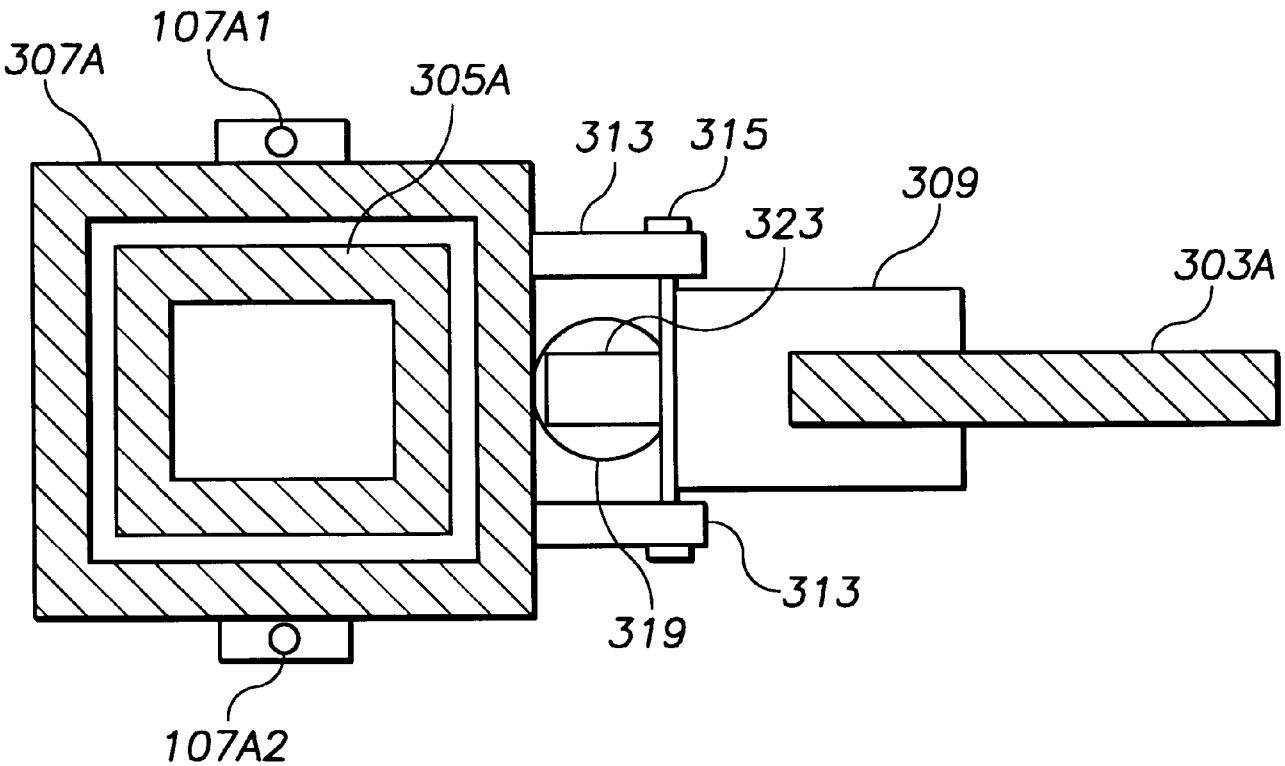
FIG. 11A is a top view and partial cross-section of an alternative embodiment of the present invention showing a weight-responsive engagement block riding on a vertical guide and engaging a vertical ratchet bar.
Figure 11B:
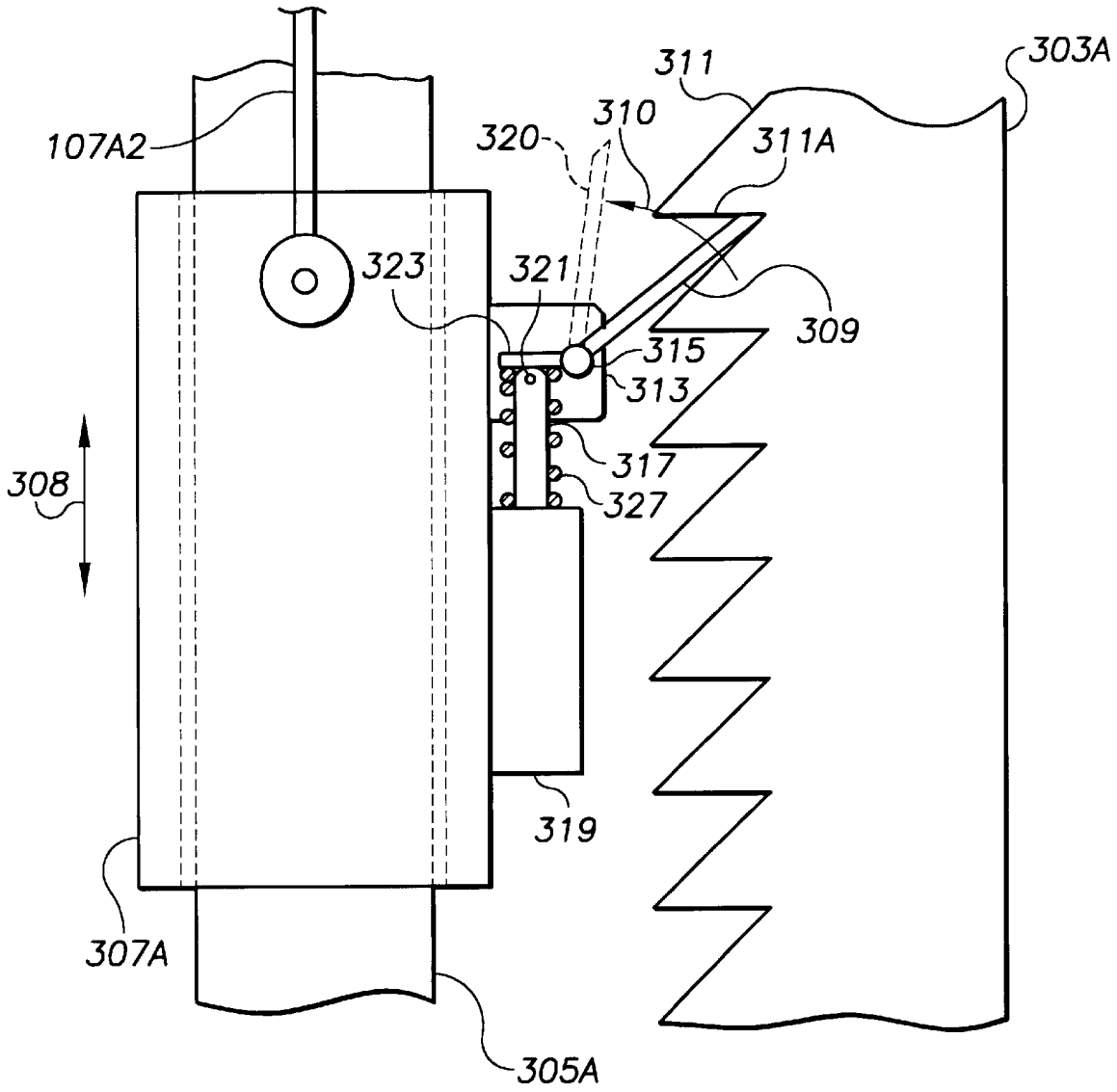
FIG. 11B is a side elevation drawing of the embodiment of FIG. 11A with one of the latch plate support brackets partially removed and the compression spring shown in cross-section for clarity.

FIGS. 11A and 11B are top and side elevation views, respectively, of an alternative embodiment of a self-spotting apparatus utilizing a fixed ratchet bar 303A substituted for each of the chain weight-support assemblies of the previous embodiment. Ratchet bar 303A and linear guide 305A are fixed to a support stand in a vertical orientation as shown in FIG. 11B. Linear guide 305A laterally constrains weight-responsive engagement block 307A and allows vertical motion of block 307A as shown by arrow 309. Cables 107A1 and 107A2 connect the free-weight assembly to block 307A and may be supported by one or more sheaves from the support stand similar to the previous embodiment.

Latch plate support brackets 313 and pivot pin 315 support pawl or latch plate 309 from block 307A. Armature 317 of solenoid 319 pivots latch plate 309 about pivot pin 315. Pin 321 pivotally connects armature 317 to lever plate 323 of latch plate 309. Latch plate 309 pivots in the direction of arrow 310 from the engaged position with tooth 311 as shown in the figure to an unengaged position as shown in the phantom lines.

In the preferred embodiments, the latch plate length, pivot pin-to-tooth distance, and tooth bottom surface 311A slope are selected so that block 307A, biased in the upward direction by the weight of the free-weights and cables 107A1 and 107A2, does not move upward as latch plate 309 pivots towards the unlatched direction of arrow 310. In the most preferred embodiments, block 307A must move downwards (against the free-weight bias) in order for latch plate 309 to move in direction 310.

Compression spring 327 biases latch plate 309 in the latched position. Solenoid 319 biases latch plate 309 toward the unlatched position 320 when energized. In the preferred embodiment, energized solenoid bias is greater than spring 327 bias on latch plate 309. However, solenoid 319 unlatching bias is not sufficient to overcome the combination of frictional forces of the end of latch plate 309 on tooth surface 311A and the placement of latch components requiring movement of block 307A downward in order to rotate latch plate 309 in direction 310. Therefore, unlatching of latch plate 309 from tooth 311A requires removal of free-weight bias on cables 107A1 and 107A2 in order for block 307A to move downward and latch plate 309 to rotate in direction 310 and fully disengage from ratchet 303.

Upon de-energizing solenoid 319, compression spring 327 rotates latch 309 to the latched position. The corresponding right side ratchet 303B, engagement block 307B, and guide 305B components are not shown, but are similar in construction and operation to the left side components.

In the preferred embodiments, solenoid 319 is energized through pressure-sensitive switches on the free-weight assembly as in the embodiment of FIGS. 7, 9 and the electrical schematic diagram of FIG. 10. The fixed ratchet embodiment of FIGS. 11A and 11B reduces the cost of the apparatus of the earlier embodiment by eliminating the chain loop assemblies, positioner and associated controls. The fixed ratchet embodiment requires that the user support most, or in the most preferred embodiments, all of the weight of the free-weight assembly in order to unlatch the engagement blocks from the ratchets and allow downward movement of the free-weight assembly. This embodiment also provides immediate latching of the engagement blocks to fully support the free-weight assembly when the user releases a pressure-sensitive switch on the free-weights.

Another embodiment combines the linear guide with the weight-support assembly as a single integrated component. For example, the linear ratchet 303A of FIG. 11B may act as both the linear guide and weight support assembly by modification of block 307A to act as a linear follower to ratchet bar 303A.

Still other embodiments comprise only a single weight-responsive engagement block and weight-support assembly. One or more cable assemblies connect the free-weight assembly to the engagement block. Other embodiments utilize a touch-sensitive actuator on the free-weight assembly instead of a pressure-sensitive switch. Still other embodiments utilize a microprocessor to perform the control and logic operations of the apparatus, as well as other timing and exercise-related functions known in the art.

Accordingly the reader will see that the SELF-SPOTTING APPARATUS FOR FREE-WEIGHTS provides a free-weight exercise machine which provides user-controlled and automatic support to barbells and dumbbells. The device provides the following additional advantages:

- The apparatus requires that the user lift the substantial weight of the free-weight before the support cables are disengaged from the chain loops;
- Once the free-weight is disengaged from the chain loops, the user may exercise the free-weight in an independent manner, allowing unrestricted vertical movement of one end with respect to the other end;
- Loosening of the grip by either hand of the user immediately engages the engagement blocks and locks the free-weight support cables to reduce the likelihood of dropping or injury;
- Independent operation of the cables and pivoting support booms allows use of barbells or dumbbells;
- The power raise feature allows "negatives" in weight training without spotters;
- Dual cable assemblies prevent dropping of weights, even upon cable failure; and
- No electrical sliding contacts are required, lowering cost and increasing reliability.

Although the description above contains many specifications, these should not be construed as limiting the scope of the invention but as merely providing illustrations of some of the presently preferred embodiments of this invention. For example, pneumatic or hydraulic actuators and controls may be employed. Thus the scope of the invention should be determined by the appended claims and their legal equivalents, rather than by the examples given.

We claim:

1. A weight-responsive engagement assembly for a free-weight self-spotting apparatus, the assembly comprising;

a body;

an engagement element attached to the body engageable with a linear weight-support assembly fixed to the self-spotting apparatus;

a linear guide follower attached to the body defining a lock-engagement direction and an opposite direction when the linear guide follower engages a linear guide attached to the self-spotting apparatus;

an engagement bias element attached to the body and operably connected to the engagement element providing continuous bias of the engagement element towards engagement with the weight-support assembly;

a disengagement bias element attached to the body and operably connected to the engagement element biasing the engagement element towards disengagement when actuated by a user-defined action;

wherein the engagement element comprises a predetermined shape and is mounted in a predetermined position on the body so that bias on the weight-responsive engagement assembly in the lock-engagement direction must be reduced for the disengagement bias element to disengage the weight-responsive engagement assembly from the weight-support assembly.

2. The weight-responsive engagement assembly of claim 1 wherein the linear guide follower comprises an aperture engageable to the linear guide.

3. The weight responsive engagement assembly of claim 1 wherein the disengagement bias element is a solenoid.

4. The weight-responsive engagement assembly of claim 3 wherein the engagement bias element is a spring.

5. The weight-responsive engagement assembly of claim 4 wherein the engagement element is a pawl engageable with a link of a chain.

6. The weight-responsive engagement assembly of claim 4 wherein the engagement element is a pawl engageable with a tooth of a linear ratchet bar.

7. A weight-responsive engagement assembly for a free-weight self-spotting apparatus, the weight responsive engagement assembly operably connecting a free-weight assembly to a linear weight-support assembly fixed to the self-spotting apparatus, the engagement assembly comprising;

a body;

an engagement element attached to the body engageable with the linear weight-support assembly;

a linear guide follower attached to the body defining a lock-engagement direction and an opposite direction when the linear guide follower engages a linear guide attached to the self spotting apparatus;

an engagement bias element attached to the body and operably connected to the engagement element providing bias of the engagement element towards engagement with the weight-support assembly;

the weight-responsive engagement comprising a means for disengaging the weight-responsive engagement assembly from the weight-support assembly when the user provides a lift support of a substantial portion of the weight of the free-weight assembly.

8. The weight-responsive engagement assembly of claim 7 wherein the means for disengaging the weight-responsive engagement assembly from the weight-support assembly is a disengagement bias element attached to the body and operably connected to the engagement element biasing the engagement element towards disengagement when actuated by a user-defined action.

9. The weight-responsive engagement assembly of claim 8 wherein the disengagement bias element is a solenoid.

10. The weight-responsive engagement assembly of claim 9 wherein the engagement element is a pawl engageable with a link of a chain.

11. The weight-responsive engagement assembly of claim 9 wherein the engagement element is a pawl engageable with a tooth of a linear ratchet bar.

* * * * *